US007285185B2

(12) United States Patent
Inoue et al.

(10) Patent No.: US 7,285,185 B2
(45) Date of Patent: Oct. 23, 2007

(54) WET PAPER WEB TRANSFER BELT

(75) Inventors: Kenji Inoue, Ibaraki-ken (JP); Hiroyuki Takamura, Tokyo (JP)

(73) Assignee: IchikawaCo., Ltd., Tokyo (JP)

( * ) Notice: Subject to any disclaimer, the term of this patent is extended or adjusted under 35 U.S.C. 154(b) by 452 days.

(21) Appl. No.: 10/966,891

(22) Filed: Oct. 15, 2004

(65) Prior Publication Data

US 2005/0098293 A1 May 12, 2005

(30) Foreign Application Priority Data

Nov. 13, 2003 (JP) ..... 2003-383674

(51) Int. Cl.

| | |
|---|---|
| ***D21F 2/00*** | (2006.01) |
| ***B32B 5/28*** | (2006.01) |
| ***B32B 5/30*** | (2006.01) |
| ***B32B 27/04*** | (2006.01) |

(52) U.S. Cl. ..... 162/306; 162/361; 162/901; 442/79; 442/118; 442/227; 442/75; 428/143

(58) Field of Classification Search ..... 162/306, 162/358.1, 358.2, 358.4, 900–903, 348, 361; 428/143; 156/462; 442/79, 118, 149, 226, 442/227, 74, 75

See application file for complete search history.

(56) References Cited

U.S. PATENT DOCUMENTS

| | | | | |
|---|---|---|---|---|
| 4,251,928 | A * | 2/1981 | Rotar et al. | 34/116 |
| 4,500,588 | A | 2/1985 | Lundstrom | |
| 4,529,643 | A | 7/1985 | Lundstrom | |
| 4,981,745 | A * | 1/1991 | Lefkowitz | 428/147 |
| 5,077,116 | A * | 12/1991 | Lefkowitz | 428/141 |
| 5,965,208 | A * | 10/1999 | Fagerholm et al. | 427/428.21 |
| 6,197,158 | B1 * | 3/2001 | Steiner | 162/205 |
| 6,276,420 | B1 * | 8/2001 | Lanthier | 156/462 |
| 6,531,033 | B1 * | 3/2003 | Kawashima | 162/306 |
| 6,547,924 | B2 * | 4/2003 | Klerelid et al. | 162/109 |
| 6,605,188 | B2 * | 8/2003 | Hagfors et al. | 162/306 |
| 2004/0154776 | A1 * | 8/2004 | Inoue | 162/358.1 |

FOREIGN PATENT DOCUMENTS

| | | |
|---|---|---|
| JP | 3264461 | 12/2001 |

* cited by examiner

*Primary Examiner*—Eric Hug
(74) *Attorney, Agent, or Firm*—Howsen & Howsen LLP

(57) ABSTRACT

A wet paper web transfer belt comprises a base body, a wet paper web side layer, and a machine side layer. The wet paper web side layer is formed of a high molecular weight elastic section, and fibers and filler particles are exposed at its surface. The fibers and filler particles are exposed in the form of an island-sea structure comprising islands section where the fibers are exposed, and a sea section where the filler particles are exposed. The fibers and the filler particles, both exposed at the wet paper web side layer, hold water at different times in the papermaking process as the wet paper web moves out of the press part of the papermaking machine.

8 Claims, 5 Drawing Sheets

WET PAPER WEB TRANSFER BELT

FIELD OF THE INVENTION

This invention relates to a wet paper web transfer belt, and especially to a transfer belt for transferring a wet paper web at high speed.

BACKGROUND OF THE INVENTION

In recent years, closed draw papermaking machines have been developed for achieving improvements in the speed of operation of a papermaking machine. The closed draw papermaking machine does not have an open draw, a part wherein a wet paper web is transferred without being supported in the papermaking process. The closed draw structure solves problems encountered in open draw machines, such as running out of paper. Thus, higher speed operation can be achieved.

A typical closed draw papermaking machine is shown schematically in FIG. 8. A wet paper web WW, shown by a broken line in the figure, is supported by press felts, PF1, PF2, a wet paper web transfer belt TB, and a dryer fabric DF, and is transferred from right to left.

As is generally known, these press felts PF1, PF2, the wet paper web transfer belt TB, and the dryer fabric DF are endless belts, and are supported by guide rollers GR.

A press roll PR, a shoe PS, a shoe press belt SB, and a suction roll SR have structures which are generally known. The shoe PS has a concave shape which conforms with the press roll PR. The shoe PS, the shoe press belt SB, and the press roll PR, form the press part PP.

The wet paper web WW passes successively through a wire part and a first press part, which are not shown, and is then transferred from the press felt PF1 to the press felt PF2. The press felt PF2 transfers the wet paper web to the press part PP. The wet paper web WW, pinched between the press felt PF2 and the wet paper web transfer belt TB, is compressed by the shoe PS, and the press roll PR, having the shoe press belt SB therebetween. The press felt PF2 has high water permeability, and the wet paper web transfer belt TB has little or no water permeability. Therefore, the water in the wet paper web WW moves to the press felt PF2 at the press part PP. Immediately after the press felt PF2, the wet paper web WW, and the wet paper web transfer belt TB, move out of the press part, the pressure is suddenly released and their volume expands. This expansion, and the capillary phenomenon exhibited by the pulp fibers forming the wet paper web WW, cause rewetting of the web WW, in which part of the water in the press felt PF2 moves to the wet paper web WW.

Since the wet paper web transfer belt TB has very low permeability, it does not hold water. Therefore, rewetting does not occur in the wet paper web transfer belt TB, and thus, the wet paper web transfer belt TB contributes to improvement in the efficiency of water removal from the wet paper web.

After the wet paper web WW moves out of the press part PP, it is transferred by the wet paper web transfer belt TB, and is sucked onto the suction roll SR and transferred to a drying process by a dryer fabric DF.

The wet paper web transfer belt TB is required to transfer a wet paper web WW while the web is attached to the belt after moving out of the press part PP, and to allow smooth removal the wet paper web from the transfer belt when he wet paper web is transferred to the next stage of the process. Conventionally, various structures have been proposed for realizing these functions. For example, U.S. Pat. No. 4,529,643 discloses a structure where a needle felt, comprising a woven fabric and a batt fiber intertwiningly integrated with the woven fabric by needle punching, is impregnated with a high molecular weight elastic material and cured. U.S. Pat. No. 4,500,588 discloses another structure which is shown in FIG. 9. In FIG. 9, a wet paper web transfer belt TB10 comprises a woven fabric 31, a batt fiber 41 intertwiningly integrated with the woven fabric 31 by needle punching, and a high molecular weight elastic section 51 provided in the batt fiber 41. This transfer belt TB10 has a wet paper web side layer TB11 and a machine side layer TB12, and is characterized in that the surface of the wet paper web side layer TB11 does not have a high molecular weight elastic section 51 and comprises only batt fibers 41.

Japanese Patent No. 3264461 discloses a further structure as shown in FIG. 10. This wet paper web transfer belt TB20 comprises a woven fabric 31, a high molecular weight elastic section 51, formed on one side of the woven fabric 31, and a batt layer 41 formed on the other side of the woven fabric 31. Therefore, the wet paper web side layer TB21 of the wet paper web transfer belt TB20 is formed by the high molecular weight elastic section 51 and a machine side layer TB22 is formed by the batt layer 41.

The surface of the wet paper web side layer TB21 is made rough, for example, by grinding. This surface has a structure wherein its surface roughness, according to JIS-B0601, a ten-point average roughness Rz, is in the range from, 0 to 20 microns when the belt is in the press part, and in the range of 2 to 80 microns after the belt moves out of the press part.

The ten-point average roughness Rz, in the range of 0 to 20 micron when the belt is in the press part, is maintained immediately after the belt moves out of the press part. In other words, the surface of the wet paper web side layer TB21 is smooth at this point. Therefore, a thin water film can be formed between the wet paper web and the surface of the wet paper web side layer TB21. The wet paper web is suitably attached to the surface of the wet paper web side layer TB21 due to the adhesion of the thin water film.

When the wet paper web transfer belt TB20 travels further, the ten-point average roughness Rz is in the range of 2 to 80 micron. Thus, the thin water film between the wet paper web and the surface of the wet paper web side layer TB21 is broken, and the adhesion is reduced. Therefore, the transfer of the wet paper web to the next stage of the process becomes easy. In other words, the wet paper web transfer belt TB20 shown in FIG. 10 and disclosed in Japanese Patent No. 3264461 realizes the function necessary for a wet paper web transfer belt.

In the case of the wet paper web transfer belt of U.S. Pat. No. 4,529,643, voids between the batt fibers are not always filled up with the high molecular weight elastic section. On the other hand, in the case of the structure of the U.S. Pat. No. 4,500,588, the wet paper web side layer is formed only by the batt layer. In both cases, the wet paper web side layer is formed by the batt layer. Therefore, in the case of these wet paper web transfer belts, a large amount of water is absorbed in the wet paper web side layer and thus, rewetting occurs occasionally. In addition, the function of transferring a wet paper web by attaching it to a transfer belt, and the function of removing the wet paper web from the transfer belt smoothly when the wet paper web is transferred to the next stage of the process, cannot be fully realized.

The wet paper web transfer belt of Japanese Patent No. 3264461 is intended to utilize the change in surface roughness caused by compression, and release of compression, of the wet paper web side layer, so that a filler breaks the water film between the wet paper and the surface of the transfer belt, web. However we have determined from testing that the filler has a reverse effect. Because of capillary action, the rough surface has a high ability to hold water between the wet paper web transfer belt and the wet paper web. Consequently, the function of smoothly transferring the wet paper to the next stage of the papermaking process is not fully realized, and thus problems are encountered in the papermaking process.

In view of the above problems, it is an object of the invention to provide a wet paper web transfer belt, in which a wet paper web is reliably transferred by attachment to a transfer belt, and the wet paper web is smoothly and reliably removed from the transfer belt for transfer to a next stage of the papermaking process.

SUMMARY OF THE INVENTION

The wet paper web transfer belt according to the invention comprises a base body, a wet paper web side layer, and a machine side layer. Fibers are exposed as islands on the surface of the wet paper web side layer, and filler particles are exposed at areas of the surface of the wet paper web side layer where the fibers are not exposed. Preferably, the ratio of the areas of the surface of the wet paper web side layer where the fibers are exposed, to the area of the surface where fibers are not exposed, is in the range of 20:80 to 80:20.

The wet paper web side layer preferably has a high molecular weight elastic section in which fibers and filler particles are mixed, and fibers and filler particles are exposed by processing the surface of the high molecular weight elastic section. The fibers and the filler particle are preferably hydrophilic.

According to the invention, the filler particles and the fibers, exposed at the surface of a wet paper web side layer, hold water with a time lag. Thus, the wet paper web can attach to the transfer belt but can be transferred smoothly to a next stage in the papermaking process.

DETAILED DESCRIPTION OF THE PREFERRED EMBODIMENTS

Figure 1:
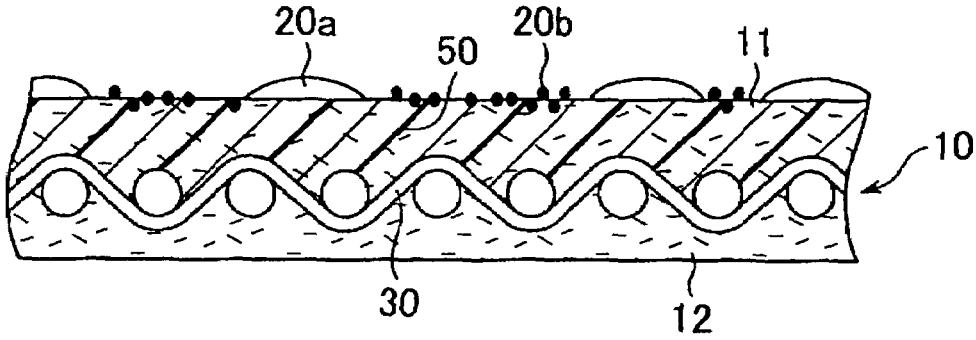
FIG. 1 is a schematic cross-sectional view, taken on a plane extending in the cross machine direction, of a wet paper web transfer belt according to the invention.

The wet paper web transfer belt 10, shown in FIG. 1, comprises a base body 30, a wet paper web side layer 11 and a machine side layer 12. The wet paper web side layer 11 is formed of a high molecular weight elastic material 50. Fibers 20*a* and filler particles 20*b* are exposed at the surface of the wet paper web side layer 11. The areas where the fibers 20*a* are exposed are in the form of "islands," which are separate from one another, within a "sea" composed of a continuous area in which filler particles 20*b* are exposed. Thus, each "island" in which fibers 20*a* are exposed is surrounded by the "sea," in which filler particles are exposed.

Figure 2:
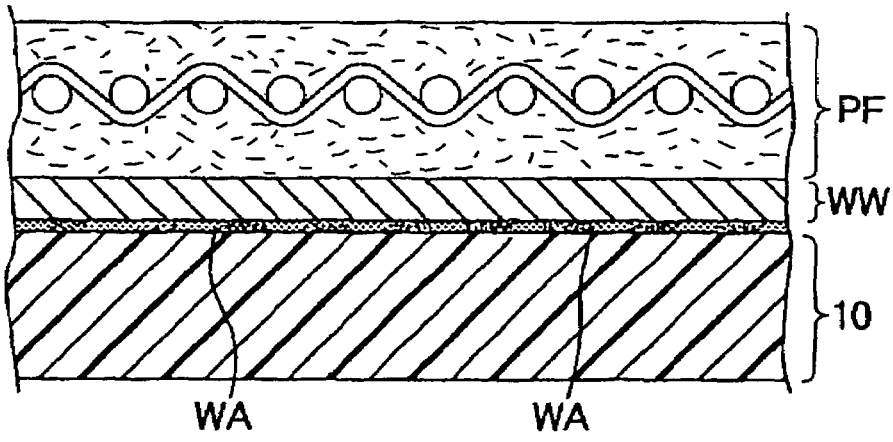
FIGS. 2-4 are schematic cross-sectional views explaining the function of a wet paper web transfer belt according to the invention.

In FIG. 2, which is a cross-sectional view of the press part of a papermaking machine, a press felt PF, a wet paper web WW, and a wet paper web transfer belt 10, are in stacked relationship. (The fibers and filler particles exposed on the surface of the wet paper web side layer of the belt 10 are omitted in FIG. 2.) The wet paper web WW is pinched between the press felt PF and the wet paper web transfer belt 10. Most of water from the wet paper web moves to the press felt PF, since the permeability of the wet paper web transfer belt is either zero or very low. Water from the wet paper web WW forms a thin water film WA between the wet paper web WW and the wet paper web transfer belt 10.

Figure 3:
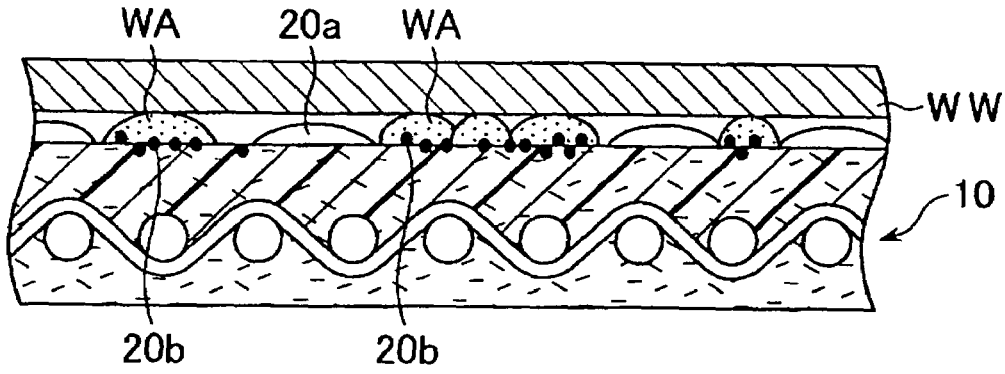

FIG. 3 depicts the wet paper web Ww, and the wet paper web transfer belt 10 after they have passed through the press part of the papermaking machine, and after the press felt has separated from the wet paper web WW. As the pressure on the wet paper web WW and the transfer belt 10 is released, the sea section, comprising the filler particle 20*b*, recovers its surface roughness slightly more quickly than the island sections where the fibers 20*a* are exposed. The sea section, in which the filler particles are exposed has a high degree of wettability. Consequently, the water WA, between the wet paper web and the wet paper web transfer belt 10, is drawn to the sea section by the surface tension of the sea section. This water held in the sea section enables the wet paper web WW to be attached to the wet paper web transfer belt 10.

Figure 4:
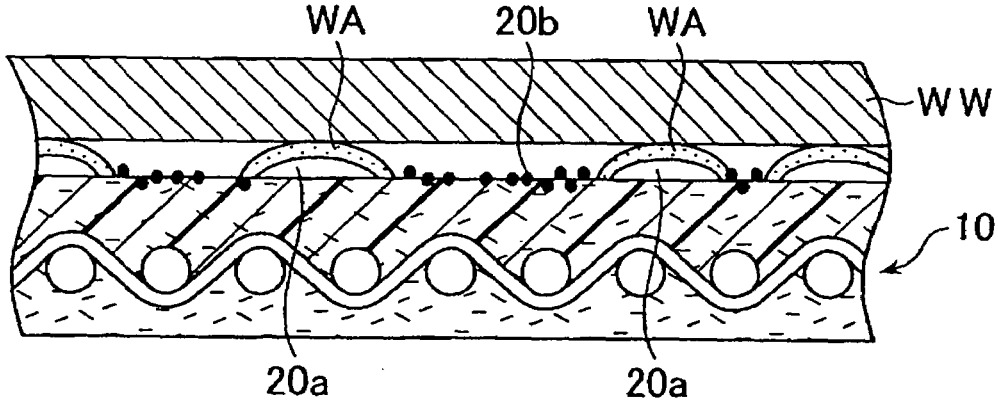

As the wet paper web and transfer belt continue to move out of the press part of the machine, the surface roughness of the islands where the fibers 20*a* are exposed fully recovers. Then, as a result of capillary action and/or hydrophilicity of the fibers, the water held in the sea section comprising the filler particle 20*b*, moves to the islands where the fibers 20*a* are exposed, as shown in FIG. 4. The water held in the islands where the fibers 20*a* are exposed, keeps the wet paper web WW attached to the belt 10.

In other words, the sea section plays an important role in keeping the wet paper web WW attached to the wet belt 10 during the short period of time while the surface roughness of the islands, is recovering. Thereafter, as the water moves to the islands, the water on the islands keeps the wet paper web attached to the belt.

The wet paper web transfer belt 10 and the wet paper web WW continue to travel, and the wet paper web WW is transferred to the next stage of the papermaking process. Since the water between the wet paper web transfer belt 10 and the wet paper web WW is held by the islands where the fiber 20*a* are exposed, the water is not in the form of a film, and does not cause strong adhesion of the wet paper web to the transfer belt. Consequently, the wet paper web can be transferred smoothly to the next stage.

The ratio of the areas of the islands and the sea section on the surface of the transfer belt has a significant effect on the transfer of water between the sea section and the islands. It has been determined that the best results are achieved when the area ratio is between 20:80 and 80:20.

The area ratio of the islands, where the fibers are exposed at the surface, to the sea section, which consists of all portions of the wet paper web-facing surface of the belt other than the islands, is measured by using an electron microscope. An electron microscope is especially suitable for taking a photograph of the surface of a wet paper web side layer of a sample, since it has some focal depth, and is not affected by the reflection of light in the case of a transparent high molecular weight material. First, the surface of a wet paper web side layer of a sample of a belt is photographed with an electron microscope. Then, the picture is scanned into a computer and clarified using software such as "Photoshop 5" from Adobe System Incorporated. The areas of the islands where fibers are exposed and the sea section are calculated using image processing software, such as "NIH image," from National Institutes of Health.

When the ratio of the area the islands to the area of the sea section is outside the range from 20:80 to 80:20, the transfer of the wet paper web while attached to the transfer belt and the smoothness of removal of the wet paper web from the belt become unsatisfactory.

The preferred fibers in the belt, for exposure at the islands, are hydrophilic rayon fibers, having a fineness in the range of about 2-15 dtex. The filler particles may be minute particles of metal powder or powdery inorganic compounds such as kaolin, clay, talc, diatomaceous earth, and bentonite. Among these materials, hydrophilic kaolin clay is preferred, especially a kaolin clay having an average particle diameter (measured by a laser measurement method) in the range from 5 micrometer to 500 micrometers, preferably 10 micrometer.

As explained above, wet paper web is attached to the sea section as a result of the wettability of the filler particles 20*b*. The islands where the fibers 20*a* are exposed, absorb water from the sea section and function to release the wet paper web, so that it can be transferred to the next stage in the papermaking process. When the area ratio of the islands to the sea section is less than 20:80, even though part of water moves from the sea section to the islands as shown in FIG. 4, most of water remains in the sea section, where the rough surface has a large capacity to hold water between the transfer belt and the wet paper web. Consequently smooth transfer of the wet paper web to the next stage in the papermaking process is impaired.

When the area ratio of the islands relative to the sea section is greater than 80:20, the surface of the transfer belt has insufficient ability to hold water between the wet paper web WW and the belt surface, as shown in FIG. 3. Therefore, the adhesive force holding the wet paper web to the belt during the time before the islands recover their surface roughness, is unstable. Poor adhesion of the wet paper web to the belt at this stage of the process impairs the functioning of the transfer belt.

Figure 5:
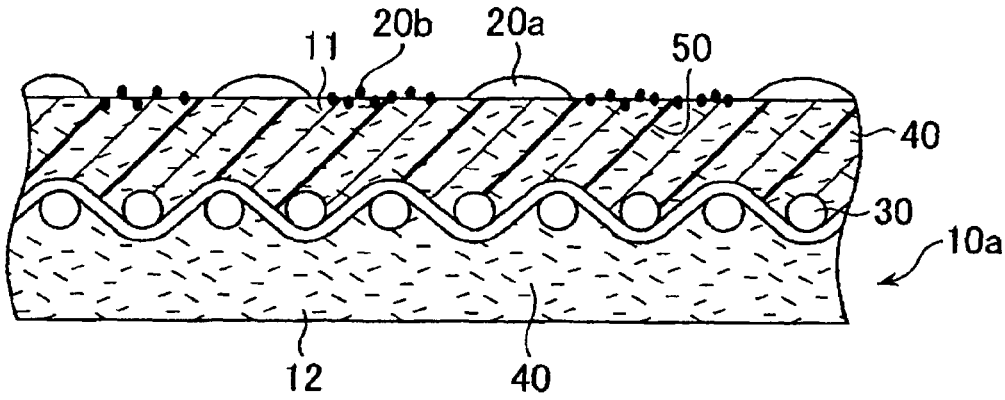
FIG. 5 is a cross-sectional view, similar to FIG. 1, of a wet paper web transfer belt in accordance with another embodiment of the invention.

In FIG. 5, which is a cross-sectional view of a wet paper web transfer belt in accordance with a first embodiment of the invention, the belt 10*a* comprises a base body 30, a wet paper web side layer 11, and a machine side layer 12. A batt layer 40 is on both sides of the base body 30. In the machine side layer 12, fibers of the batt layer 40 are intertwiningly integrated with the machine side of the base body 30. In the wet paper web side layer 11, a high molecular weight elastic layer 50 is impregnated into the part of the batt layer 40 on the wet paper web side of the base body, and cured after filler particles 20*b* are sprinkled on the top of layer 50. An island-sea structure is obtained by grinding the surface of the wet paper web side layer 11 with sandpaper, a whetstone, or the like to expose a part of the batt layer 40 as well as the filler particles 20*b*. Thus, an island-sea structure is formed, which comprises islands where fibers 20*a* are exposed, and a sea section in which filler particles 20*b* are exposed on the surface of a high molecular weight elastic section 50.

Figure 6:
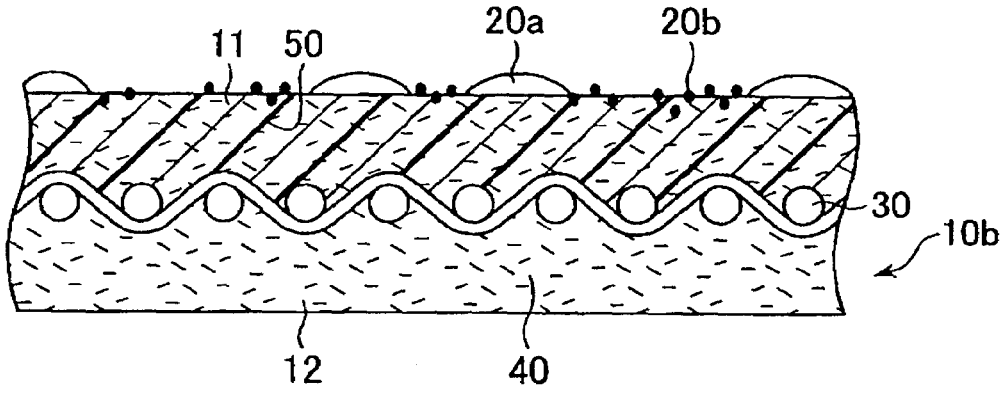
FIG. 6 is a cross-sectional view, similar to FIGS. 1 and 5, of a wet paper web transfer belt in accordance with still another embodiment of the invention.

In FIG. 6, which is a cross-sectional view of another wet paper web transfer belt in accordance with a second embodiment of the invention, the belt 10*b* similarly comprises a base body 30, a wet paper web side layer 11, and a machine side layer 12. As in the case of the first embodiment, the machine side layer 12 comprises a batt layer 40 comprising a batt fiber intertwiningly integrated with the machine side of the base body 30. However, in this case, the island-sea structure is obtained by mixing the fibers 20*a* and filler particles 20*b* in a liquid, high molecular weight elastic material to form the high molecular weight elastic section 50. After the high molecular weight elastic material, in which the fibers 20*a* and the filler particles 20*b* are mixed, is cured, the fibers 20*a* and the filler particles 20*b* are exposed by grinding the surface of the high molecular weight elastic section 50 with sandpaper, whetstone or the like.

In both cases, the island-sea structure comprising the island section where fibers 20*a* are exposed and the sea section comprising filler particle 20*b*, are obtained by grinding the surface of the wet paper web side layer 11 comprising a high molecular weight elastic section 50. Therefore, the wet paper web side layer 11 of the wet paper web transfer belt according to the invention contributes to the formation of an excellent paper surface since the smoothness of the surface of the transfer belt becomes greater than that of the wet paper web contacting surface of a press felt PF.

Organic fibers such as nylon, polyester, aramid, rayon, wool, cotton, hemp, acrylic, etc., and inorganic fibers such as glass fibers, are suitable for use as the fibers of the transfer belt. It is desirable that the islands where the fibers 20*a* are exposed be hydrophilic, i.e. that they attract and/or hold water. A hydrophilic fiber, for example, can be hygroscopic. In such a case, the fiber has an affinity for water since the fiber absorbs water. It has been determined that excellent results can be obtained when the official moisture regain is 4.0% or more, and preferably 5.0% or more. Official moisture regain is a numerical value calculated by using a formula for "official moisture regain" specified in JIS L 0105 (general principles of physical testing methods for textiles).

Specifically, nylon, having an official moisture regain figure of 4.5%, vinylon having an official moisture regain figure of 5.0%, rayon having an official moisture regain figure of 11.0%, cotton having an official moisture regain figure of 8.5%, and wool having an official moisture regain figure of 15.0%, and the like can be used as fibers in the wet paper web side layer material for said fiber body.

On the other hand, fiber to which hydrophilic properties are imparted by chemical or physical treatment can also be used. Suitable treatments, well-known among those skilled in the art, include mercerizing, resin processing, sputtering by ionizing radiation, glow discharge processing, etc. In the case of hydrophilic processing, excellent results can be obtained where the moisture of a processed monofilament or a spun yarn is adjusted to be between 30% and 50% (water/total weight)×100), and the contact angle with water is below 30 degrees.

Various resins, including both thermosetting resins and thermoplastic resins, can be used as the material for a high molecular weight elastic section. Hydrophobic or hydrophilic materials can be used, fibers and filler particles can be optionally mixed into the resin as mentioned previously.

The wet paper web transfer belt according to the invention can have zero permeability. However, if the papermaking machine requires a belt having some permeability, the belt can be so constructed. In this case, a desired structure can be obtained by reducing the amount of an impregnated high molecular weight elastic material, increasing the amount of grinding, or using a high molecular weight elastic material having open cells. However, even in the case of a permeable belt, the permeability should be 5 cc/cm$^2$/sec or less. Permeability is measured by "A method (a fragile type testing machine)" specified in JIS L 1096 (a test method of a general woven fabric).

The principal function of the base body 30 is to impart strength to the wet paper web transfer belt. While a woven fabric, woven from machine direction yarns and cross machine direction yarns, is shown in FIGS. 5 and 6, the base body can have various other structures as appropriate, and can consist, for example, of a non-woven fabric composed of overlapping machine direction and cross machine direction yarns, films, a knitted fabrics, and belt-shaped bodies produced by winding a narrow, belt-like, body in a spiral.

Although FIGS. 5 and 6 show a machine side layer 12 which consists only of a batt layer 40, the machine side layer 12 is not limited to this structure, and can be formed, for example, of a batt layer impregnated with a high molecular weight elastic material or, can consist of a high molecular weight elastic section.

Ten examples of a wet paper web transfer belt were produced.

In the first five examples (examples 1-5), an endless woven fabric was impregnated with urethane resin and cured. The urethane resin coated the inner surface of the woven fabric and was impregnated into the woven fabric and furthermore, laminated over the outer surface of the woven fabric. Before curing of the resin, a rayon pile having a thickness of 6 dtex, and a fiber length of 3 mm, and kaolin clay with an average particle diameter of 10 microns, used as filler particles, were scattered over the uncured urethane resin which was laminated on the outer surface of the woven fabric. The resin was cured while the fibers were slightly buried under the surface of the uncured resin. The surface of the cured urethane resin was then ground with sandpaper. The above process produced an island-sea structure on the outer surface (of the wet paper web side layer). This island-sea structure comprised islands where the fibers 20*a* were exposed, and a sea section comprising filler particles 20*b*. The area ratios of the island section to the sea section in examples 1-5 were 10:90, 20:80, 50:50, 80:20, and 90:10 respectively.

In the next group of five examples (examples 6-10), a needle felt was obtained by intertwiningly integrating fiber mats with the outer and inner surfaces of an endless woven fabric by needle punching respectively. A fiber mat comprising nylon-6 staple fibers with a thickness of 6 dtex was used. The density of the needle felt was increased by heat-pressing. The area ratio of the islands was adjusted by controlling the density of the needle felt. Resin was coated over the needle felt from its outer surface, and then filler was scattered over the uncured needle felt. (Alternatively, resin containing filler can be coated over the needle felt from its outer surface.) The urethane resin was then cured, and the surface of the cured urethane resin was ground with sandpaper. An island-sea structure comprising islands where the fibers 20*a* were exposed, and a sea section comprising filler particle 20*b*, was formed on the outer surface of the wet paper web side layer by the above process. The area ratios of the islands to the sea section in examples 6-10 were 10:90, 20:80, 40:60, 60:40, and 80:20 respectively.

Figure 7:
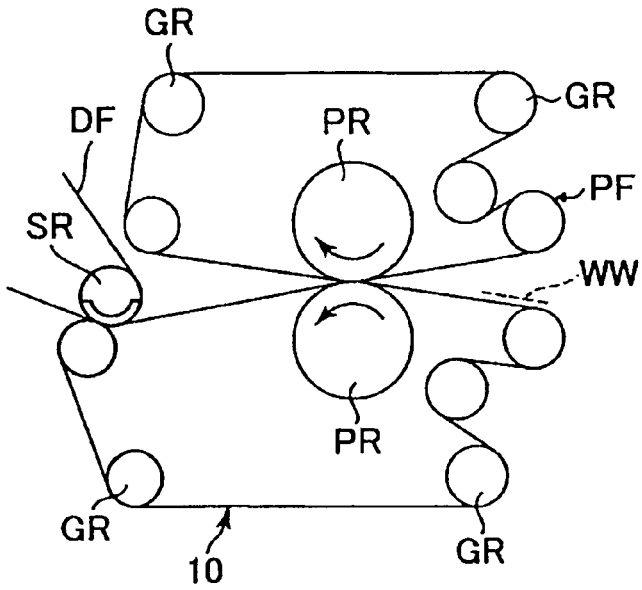
FIG. 7 is a schematic view of an apparatus for evaluating the performance wet paper web transfer belts.
Figure 8:
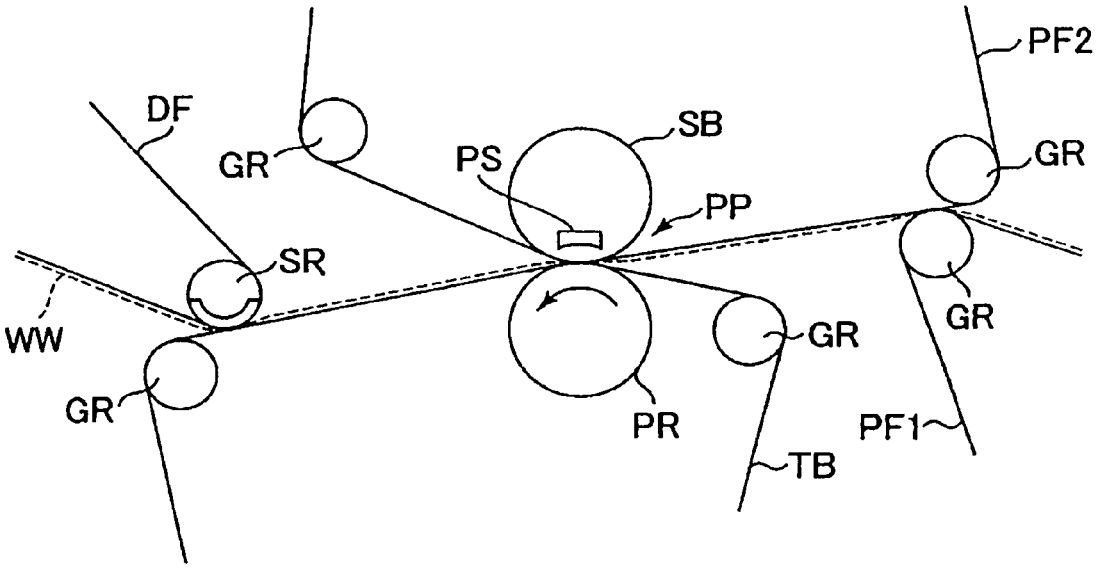
FIG. 8 is a schematic view of a typical closed draw paper-making machine.
Figure 9:
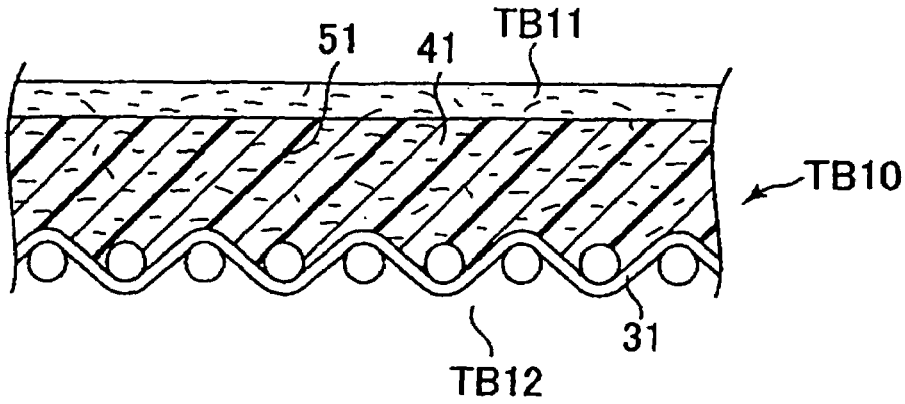
FIG. 9 is a cross-sectional view of a conventional wet paper web transfer belt.
Figure 10:
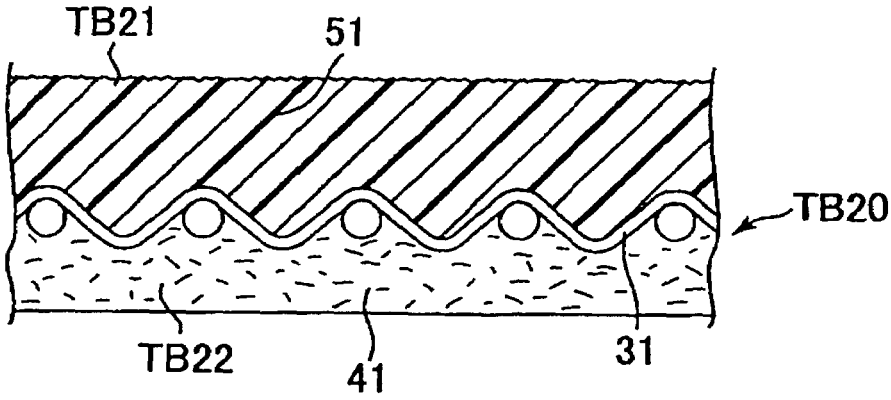
FIG. 10 is a cross-sectional view of another conventional wet paper web transfer belt.

Tests of the ten examples of e wet paper web transfer belt were conducted, using the apparatus shown in FIG. 7. This apparatus comprises a pair of press rolls PR forming a press part, a press felt PF, and a wet paper web transfer belt 10. The press felt and the transfer belt are pinched by the press rolls, and supported at a predetermined tension by a plurality of guide rolls GR. The press felt and the transfer belt move along with the rotation of the press rolls PR. Although only a part of a dryer fabric DF is shown in FIG. 7, the dryer fabric is also endless, and supported and driven by the guide rolls GR as well as the press felt PF and the wet paper web transfer belt 10.

A wet paper web WW is placed on the wet paper web transfer belt 10 of this apparatus, upstream relative to the press part. The wet paper web WW passes through the press part, and is transferred to the dryer fabric DR by the suction applied by a suction roll SR.

Tests were conducted by using this apparatus and performance of the wet paper web transfer belts was evaluated, first for stability of the wet paper web WW on the wet paper web transfer belt 10 immediately after the wet paper web moves out of a press part, and secondly for transfer stability of the wet paper web WW to the dryer fabric DF. Evaluations were conducted by visual observation.

The tests were conducted at a driving speed of 150 m/min, and applied pressure in the press part of 40 kg/cm, and a vacuum, at the suction roll SR, of 150 mm Hg. A wet paper web WW comprising kraft pulp, with a basis weight of 80 g/m$^2$, and a dryness of 38%, was used. The press felt PF had a conventional structure, comprising a woven fabric and a batt layer intertwiningly integrated with the woven fabric by needle punching. The press felt PF had basis weight of 1200 g/m$^2$ and its batt fiber had a fineness of 10 dtex.

The results of the tests are shown in the following table.

| Example | Area ratio of island section to sea section | Evaluation on adhesion of wet paper web right after getting out of press | Evaluation on removability of wet paper web right before being transferred to next process | Total evaluation |
|---|---|---|---|---|
| 1 | 10:90 | good | fail | fair |
| 2 | 20:80 | good | good | good |
| 3 | 50:50 | good | good | good |
| 4 | 80:20 | good | good | good |
| 5 | 90:10 | fail | good | fair |
| 6 | 10:90 | good | fail | fair |
| 7 | 20:80 | good | good | good |
| 8 | 40:60 | good | good | good |
| 9 | 60:40 | good | good | good |
| 10 | 80:20 | fair | good | fair |

It was determined as a result of the tests, that adhesion of a wet paper web immediately after the wet paper web moved out of the press part, and removal of the wet paper web, were good in the case of examples 2-4 and 7-9. On the other hand, in the case of examples 1 and 6, the wet paper web WW was not smoothly transferred to the next stage of the papermaking process (the dryer process), since adhesion of the wet paper web WW was excessively high immediately after the wet paper web moved out of the press part. In addition, in the case of examples 5 and 10, adhesion of the wet paper web dropped immediately after the wet paper web moved out of the press part, and some oscillation occurred.

As explained above, according to the invention, the fibers and filler particles, exposed on the surface of a wet paper web side layer, hold water from a wet paper web, and therefore, the transfer of the web by attachment to a transfer belt, and the removal of web from the transfer belt when the web is transferred to the next stage of the process, take place smoothly.

We claim:

1. A wet paper web transfer belt for use in a press part of a closed draw papermaking machine, comprising a base body, a wet paper web side layer on one side of the base body, the wet paper web side layer comprising a high molecular weight elastic material having a surface, and a machine side layer on the opposite side of the base body, wherein fibers are exposed as islands on the surface of said elastic material, plural fibers are exposed at each of said islands, said islands are separated from one another by areas on which fibers are not exposed, and filler particles are exposed on said areas on which fibers are not exposed.

2. A wet paper web transfer belt according to claim 1, wherein the ratio of the areas of said surface on which fibers are exposed to the area of said surface on which fibers are not exposed, is in the range of 20:80 to 80:20.

3. A wet paper web transfer belt according to claim 1, wherein fibers and filler particles are mixed in said elastic section, and wherein fibers and filler particles are exposed by processing the surface of said elastic section.

4. A wet paper web transfer belt according to claim 2, wherein fibers and filler particles are mixed in said elastic section, and wherein fibers and filler particles are exposed by processing the surface of said elastic section.

5. A wet paper web transfer belt according to claim 1, wherein said fibers and said filler particles are hydrophilic.

6. A wet paper web transfer belt according to claim 2, wherein said fibers and said filler particles are hydrophilic.

7. A wet paper web transfer belt according to claim 3, wherein said fibers and said filler particles are hydrophilic.

8. A wet paper web transfer belt according to claim 4, wherein said fibers and said filler particle are hydrophilic.

* * * * *